US005992588A

United States Patent [19]

Morszeck

[11] Patent Number: 5,992,588

[45] Date of Patent: Nov. 30, 1999

[54] WHEELED SUITCASE

[75] Inventor: Dieter Morszeck, Cologne, Germany

[73] Assignee: Rimowa Kofferfabrik GmbH, Cologne, Germany

[21] Appl. No.: 09/101,883

[22] PCT Filed: Dec. 3, 1996

[86] PCT No.: PCT/EP96/05354

§ 371 Date: Jul. 20, 1998

§ 102(e) Date: Jul. 20, 1998

[87] PCT Pub. No.: WO97/25894

PCT Pub. Date: Jul. 24, 1997

[30] Foreign Application Priority Data

Jan. 19, 1996 [DE] Germany ..... 296 00 922

[51] Int. Cl.[6] ..... A45C 5/14

[52] U.S. Cl. ..... 190/18 A; 190/39; 190/115; 280/37

[58] Field of Search ..... 190/18 A, 115; 280/37; 16/31, 47, 115

[56] References Cited

U.S. PATENT DOCUMENTS

| | | | |
|---|---|---|---|
| 2,439,660 | 4/1948 | Keil | 190/18 A X |
| 2,596,578 | 5/1952 | Mc Intyre et al. | 190/18 A X |
| 4,321,727 | 3/1982 | Sheiman et al. | 190/18 A X |
| 4,385,415 | 5/1983 | Volz | 190/18 A X |
| 4,463,840 | 8/1984 | Seynhaeve | 190/18 A |
| 4,679,670 | 7/1987 | Wickman | 190/18 A |
| 4,854,602 | 8/1989 | Takeuchi | 190/122 X |
| 5,044,476 | 9/1991 | Seynhaeve | 190/18 AQ |
| 5,197,578 | 3/1993 | Van Hooreweder | 190/18 A |

FOREIGN PATENT DOCUMENTS

| | | | |
|---|---|---|---|
| 153354 | 9/1950 | Australia | 190/18 A |
| 513460 | 11/1992 | European Pat. Off. . | |
| 3307838 | 9/1983 | Germany . | |
| 9522266 | 8/1995 | WIPO . | |

*Primary Examiner*—Sue A. Weaver
*Attorney, Agent, or Firm*—Diller, Ramik & Wight, PC

[57] ABSTRACT

The invention concerns a suitcase which comprises two case halves (3,4) each having a main surface (2) with a carrying handle (5) secured on the upper side (6) of one case half (4), casters (16) disposed at corners (12,14) at one end (8) of the base (10), the casters (16) projecting relative to the base (10) and the adjacent first vertical narrow side (18) of the case halves, and with a pulling handle (22) which is disposed diagonally opposite the casters (16) in the upper region of the second vertical narrow side (10) of the case halves (3,4). According to the invention, disposed at each upper corner (24,26) of the first vertical narrow side (18) is a guide roller (30) which can pivot about an axis (28) parallel with the upper side (6) of the case halves (3,4), the guide roller (30) having at least one caster (32, 34) and the pivot axis (28) being at a spacing of at most approximately 25 mm, and preferably at most 20 mm, from the main surface (2) and/or the upper side (6) of the respective case half (3,4).

20 Claims, 3 Drawing Sheets

WHEELED SUITCASE

BACKGROUND OF THE INVENTION

Such a suitcase is known, for example, from DE 33 07 838, EP 0 175 022 A and EP 0 247 321 A.

Furthermore, suitcases are known which are provided, at the frontal face thereof, with guide roller inserts comprising a small guide roller having a diameter of approximately 30 mm. These guide rollers are arranged in a recessed manner in a casing embedded in the frontal face of the suitcase. The disadvantage of the known guide roller consists in their being arranged at a greater distance from the main surfaces of the suitcase, whereby the base width between the two guide rollers is small. In connection with the small diameter of the guide rollers, the suitcase has a strong tendency to tilt, even in the case of a minor unevenness of a floor, which tendency requires an increased attention when rolling the suitcase.

SUMMARY OF THE INVENTION

The invention is based on the object to improve a suitcase of the kind mentioned above so that it can be guided in a stable manner without tilting, even when rolling in an upright position.

Advantageously, the invention provides that a guide roller is arranged with at least one caster on each of the upper corners of the first vertical narrow side of the suitcase, the rotational axis of the guide roller having a distance from the main surface of the corresponding case half and from the upper surface of the case half which amounts to a maximum of 2.5 cm, preferably a maximum of 2 cm.

The arrangement of the rotational axis of the guide roller with a small distance from the upper surface of the suitcase and from the main surface of the suitcase causes a base width as wide as possible to be formed between the two guide rollers on the corners of the suitcase, which base width increases the stability of the suitcase. Apart from that, the tendency to tilt is reduced by the position of the rotational axis of the guide rollers relative to the center of gravity of the suitcase.

The rotational axis of the casters extends parallel to the vertical narrow side of the suitcase at a distance to the rotational axis of the guide roller. This offsetting of the axes causes the guide roller to be easily steerable due to the lever forces acting thereupon.

In a preferred exemplary embodiment, it is provided that the at least one caster of the guide roller has a diameter of approximately 35 to 70 mm, preferably 40 to 60 mm. The use of a larger caster also reduces the tendency to tilt in the case of smaller ground beams and obstacles.

The projecting length of the at least one caster relative to the plane of the first vertical narrow side amounts to approximately 15 mm. In the case of such a distance, on the one hand, smaller obstacles can still be crossed without the suitcase touching down, on the other hand, the guide roller does not project beyond the vertical narrow side as far as to be disturbing in the normal position of the suitcase.

Preferably, the guide roller comprises two parallel coaxially arranged casters, the running planes thereof extending at the same distance from the rotational axis of the guide roller. Such a guide roller provides the suitcase with a higher stability and reduces the danger of the suitcase tilting to the side.

In a preferred exemplary embodiment, the guide roller is provided in a casing comprising a flange for attachment to the main surface of the upper side and the first vertical narrow side. Within the casing, a recess is provided in which the guide roller is mounted to be arranged in a recessed manner and can be pivoted freely.

There now follows a more detailed description of an exemplary embodiment of the invention with reference to the accompanying drawings.

DESCRIPTION OF THE PREFERRED EMBODIMENTS

Figure 1:
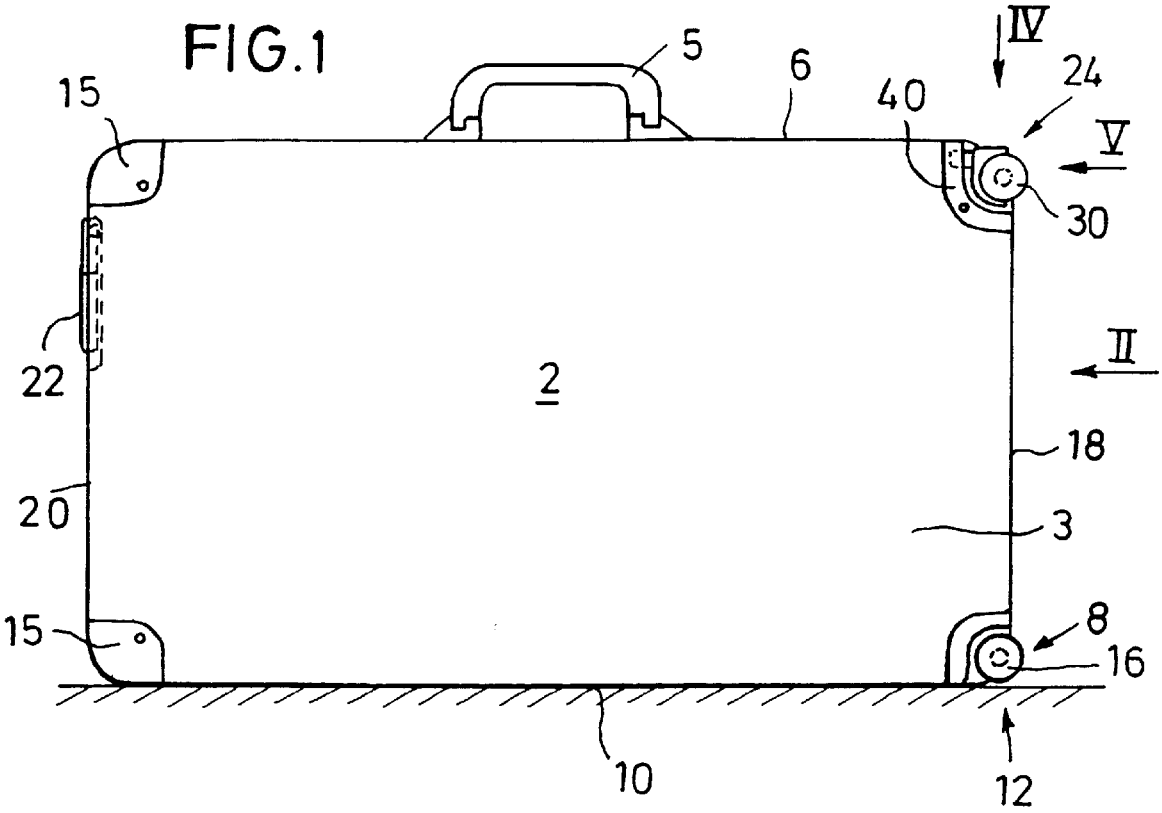
FIG. 1 shows a suitcase according to the invention with a set of casters and a set of guide rollers.
Figure 2:
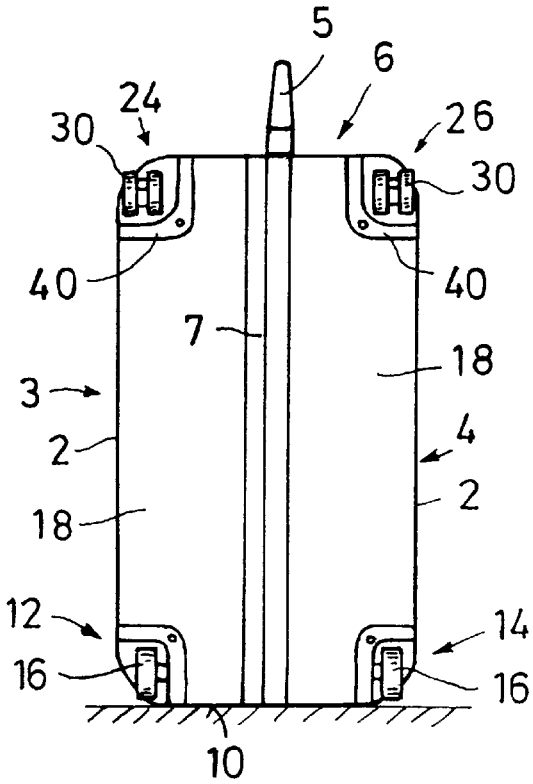
FIG. 2 shows a top plan view onto the vertical narrow side of the suitcase provided with rollers.
Figure 3:
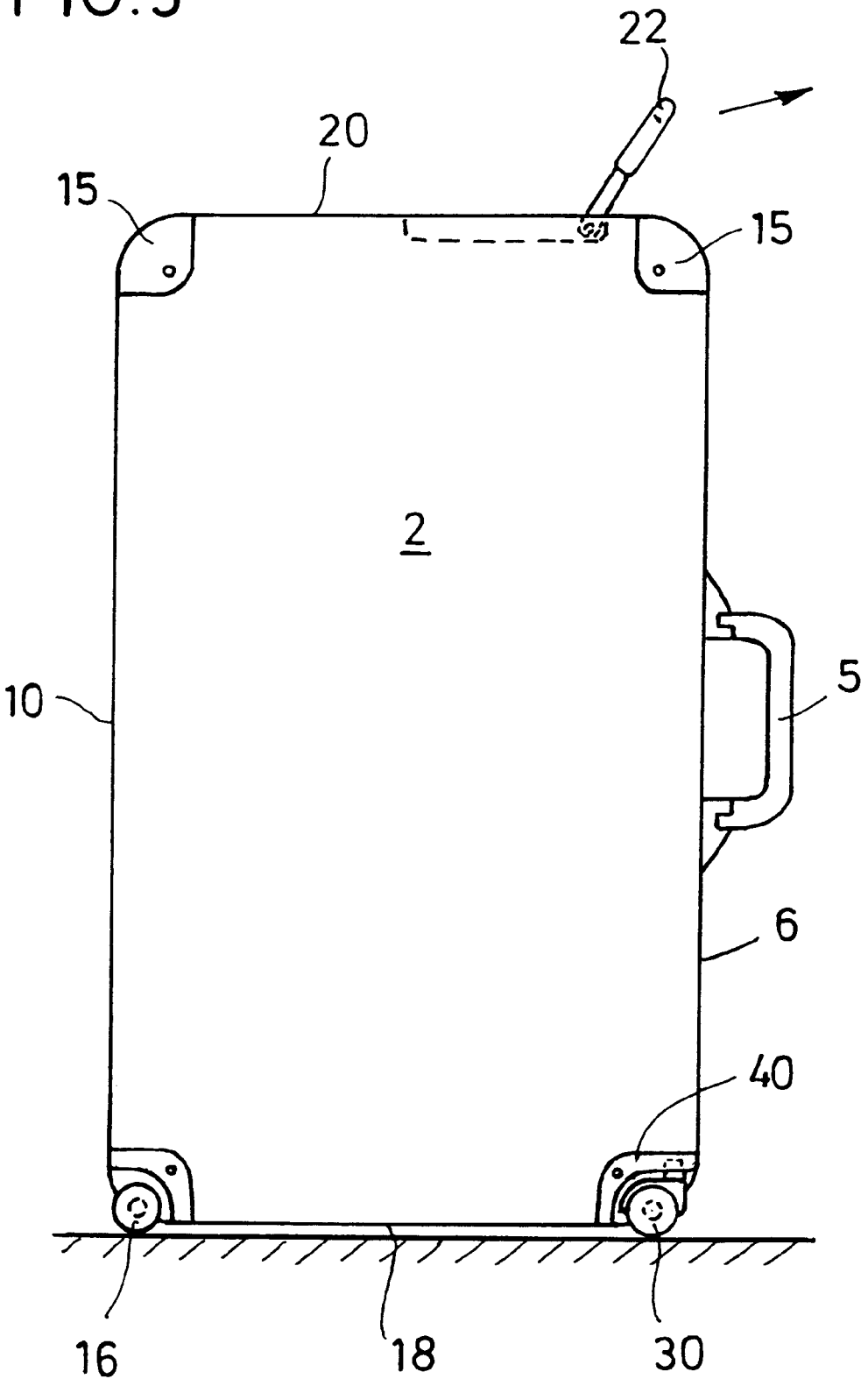
FIG. 3 shows a suitcase positioned upright and being movable on the casters.
Figure 4:
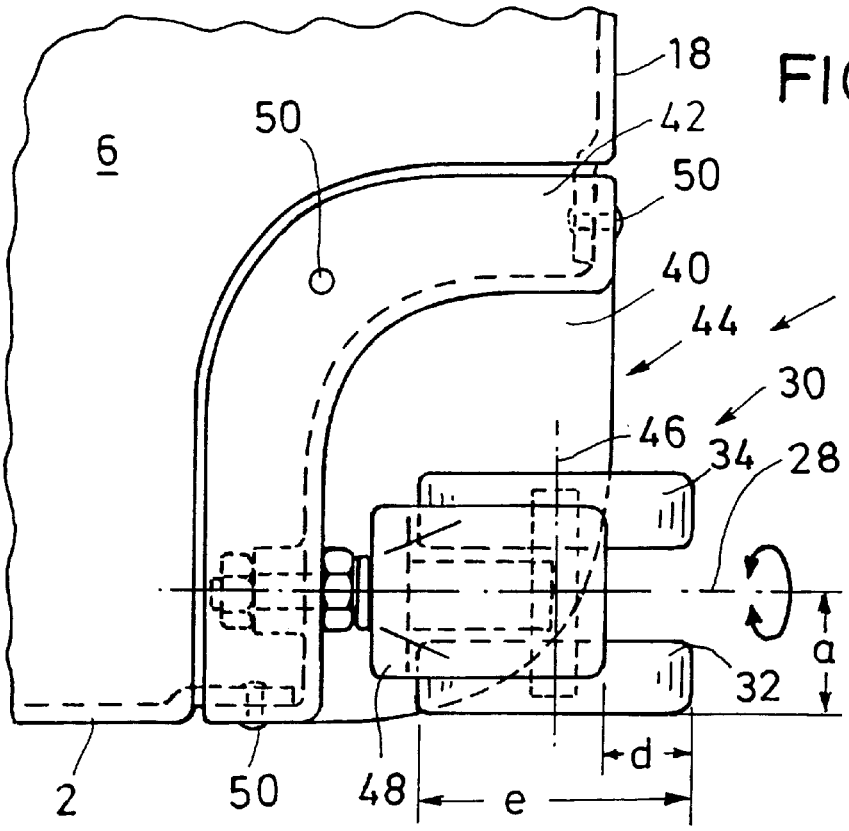
FIG. 4 shows a view of a suitcase corner provided with guide rollers, in the direction indicated in FIG. 1.
Figure 5:
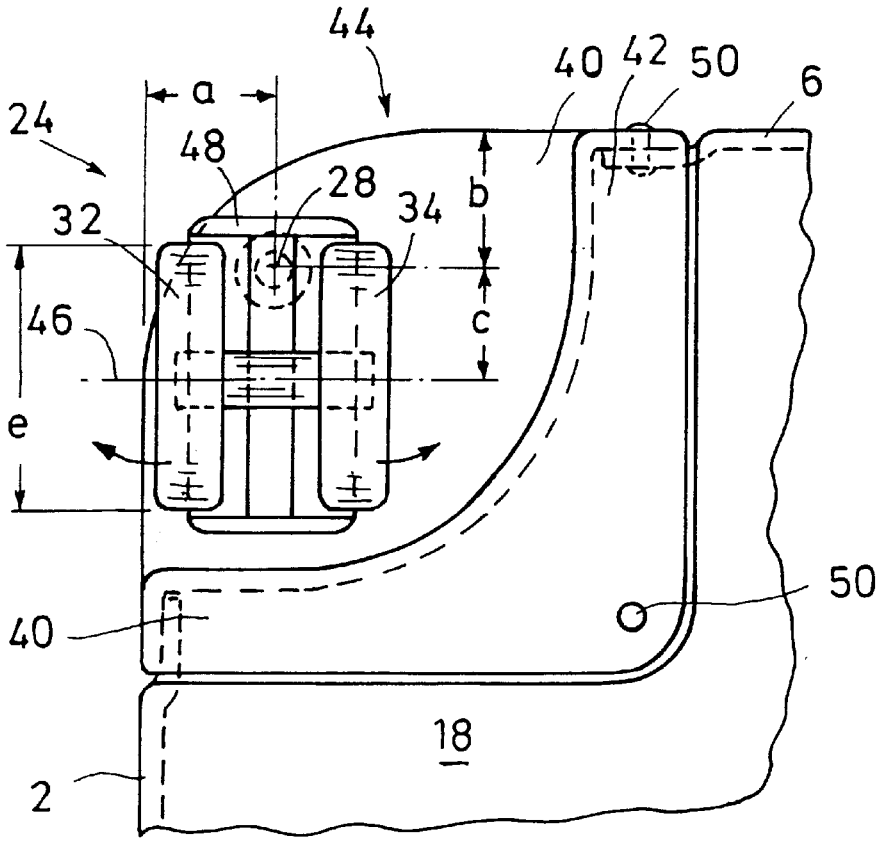
FIG. 5 shows a view of the same suitcase corner in the direction indicated in FIG. 1.

The suitcase shown in FIG. 1 consists of two case halves 3,4 each comprising a main surface 2 and each comprising a frame 7 adapted to each other. A carrying handle 5 is secured approximately in the center of the horizontal upper side 6 of the suitcase on the case half 4. On the lower end, the usually horizontal base 10 of the suitcase extends parallel to the upper side 6, casters 16 being arranged on the suitcase corners 12,14 on the one end 8 of the base, which casters project relative to the base 10 and the adjacent first, normally vertical narrow side 18 of the case halves 3,4. The casters 16 rotate about a rigid rotational axis extending parallel to the base 10 and the narrow side 18. In the upper region of the second vertical narrow side 20, a swing-out pulling handle 22 is disposed approximately diagonally opposite the casters 16, the handle section of which handle extends parallel to the narrow side 20 and the upper side 6. A corner protection 15 is provided on each of the upper and lower corners of the usually vertical second narrow side 20.

On each of the upper suitcase corners 24,26 of the first vertical narrow side 18, a guide roller 30 pivotable about a rotational axis 28 parallel to the upper side 6 of the case halves 3,4 and comprising at least one caster 32,34 is provided. The rotational axis 28 has a small distance (a) from the main surface 2 and a small distance (b) from the upper side 6 of the respective case halves 3,4. This distance amounts to a maximum of about 25 mm, preferably to a maximum of 20 mm.

The guide roller 30 consists of a guide roller housing 48 pivotable about a rotational axis 28 parallel to the upper side 6 of the suitcase. Two casters 32, 34 arranged at a distance from each other are pivoted on a rotational axis 46 orthogonal to the rotational axis 28 and are offset relative to the rotational axis 28 by a distance (c). The distance (a) of the rotational axis 28 relative to the main surface 2 and the distance (b) of the rotational axis 28 relative to the upper side 6 are preferably equal.

In the case of an especially preferred exemplary embodiment, the diameter (e) of the casters 32,34 amounts to 50 mm. The mutual distance of the guide rollers amounts to 30 mm, while the projection (d) of the casters 32,34 relative to the first vertical narrow side 18 amounts to about 15 mm. The distances (a),(b) amount to about 20 to 25 mm.

The guide roller housing 48 is connected to a casing 40 via a fixed peg with a flange 42, the flange 42 being connected to the main surface 2 of the upper side 6 and the first vertical narrow side 18 of the two suitcase halves 3,4 via rivets 50. For this purpose, a corresponding recess is formed in the suitcase walls on the upper suitcase corners 24,26. The casing 40 for the guide roller 30 comprises a recess 44 in which the guide roller 30 is arranged in a recessed manner, so that it only projects beyond the vertical narrow side 18, for example in the position represented in the Figures. The guide roller 30 is freely pivotable within the recess 44.

It is evident that the guide rollers 30 can also be arranged without the casing 40 in the case halves 24,26 in a recess corresponding to the recess 44, if the case halves 3,4 are designed correspondingly.

The small distance (a) between the rotational axis 28 and the main surface 2 as well as the offset arrangement of the casters 32 relative to the rotational axis 28 allow for a base width of support of the suitcase practically extending across the entire width of the narrow side 18 of the suitcase. If the suitcase is positioned upright so as to run on the two casters 16 and the two guide rollers 30, a high stability without tilting is ensured, which is even improved by using large casters 32,34. The guide rollers 30 with two casters 32,34 have the property to rotate without strong resistance so that the suitcase can be guided very easily and comfortably by means of the swing-out handle 22 when in the upright position, without an increased danger of tilting in the case of a lesser unevenness of the ground surface and smaller obstacles.

Although a preferred embodiment of the invention has been specifically illustrated and described herein, it is to be understood that minor variations may be made in the apparatus without departing from the spirit and scope of the invention, as defined the appended claims.

What is claimed is:

1. A suitcase comprising two case halves (3, 4) having a main surface (2), a first vertical narrow side (18), a second vertical narrow side (20), a base (10) and an upper side (6); a carrying handle (5) on one of the case halves (3, 4) on the upper side (6), casters (16) arranged on one end (8) of the base (10) at suitcase corners (12, 14), said casters (16) project relative to the adjacent first vertical narrow side (18) of the case halves (3, 4), a handle (22) arranged at an area of the second vertical narrow side (20) of the case halves (3, 4), one guide roller (30) pivotable about a rotational axis (28) parallel to the upper side (6) of each of the case halves (3, 4) in associated recesses, each guide roller (30) having at least one caster (32, 34) rotatable about a horizontal axis (46) and being arranged at upper suitcase corners (24, 26) of the first vertical narrow side (18), the distance (a) of the rotational axis (28) of the guide roller (30) from the main surface (2) and the distance (b) of the rotational axis (28) from the upper side (6) of the corresponding case halves (3, 4) are smaller than the diameter of the guide roller (30) and amount to a maximum of 25 mm.

2. The suitcase as defined in claim 1 wherein the relation of the distance (a) or (b) of the rotational axis (28) to the diameter of the guide roller (30) amounts to about 0.3 to 0.7.

3. The suitcase as defined in claim 2 wherein the distances (a, b) amount to a maximum of 20 mm.

4. The suitcase as defined in claim 3 wherein the rotational axis (46) of the at least one caster (32, 34) extends parallel to the first narrow side (18) at a distance from the rotational axis (28).

5. The suitcase as defined in claim 2 wherein the rotational axis (46) of the at least one caster (32, 34) extends parallel to the first narrow side (18) at a distance from the rotational axis (28).

6. The suitcase as defined in claim 2 wherein the guide roller (30) includes two parallel casters (32, 34) mounted coaxially and defining running planes (36, 38) which extend the same distance from the rotational axis (28) of the guide roller (30).

7. The suitcase as defined in claim 2 wherein the guide roller (30) is mounted in a casing (40) including a connection flange (42) for the main surface (2), the upper side (6) and the first vertical narrow side (18), and a recess (44) in which the guide roller (30) is housed the guide roller (30) is housed, and the guide roller (30) projects beyond the first vertical narrow side (18) by a predetermined amount corresponding substantially to the amount of projection of the casters (16).

8. The suitcase as defined in claim 2 wherein the rotational axis (46) of the casters (32, 34) is spaced a distance from the orthogonally extending rotational axis (28) of the guide roller (30) of about 15 to 25 mm.

9. The suitcase as defined in claim 1 wherein the distances (a, b) amount to a maximum of 20 mm.

10. The suitcase as defined in claim 9 wherein the rotational axis (46) of the at least one caster (32, 34) extends parallel to the first narrow side (18) at a distance from the rotational axis (28).

11. The suitcase as defined in claim 9 wherein the guide roller (30) includes two parallel casters (32, 34) mounted coaxially and defining running planes (36, 38) which extend the same distance from the rotational axis (28) of the guide roller (30).

12. The suitcase as defined in claim 9 wherein the guide roller (30) is mounted in a casing (40) including a connection flange (42) for the main surface (2), the upper side (6) and the first vertical narrow side (18), a recess (44) in which the guide roller (30) is housed, and the guide roller (30) projects beyond the first vertical narrow side (18) by a predetermined amount corresponding substantially to the amount of projection of the casters (16).

13. The suitcase as defined in claim 9 wherein the rotational axis (46) of the casters (32, 34) is spaced a distance from the orthogonally extending rotational axis (28) of the guide roller (30) of about 15 to 25 mm.

14. The suitcase as defined in claim 1 wherein the rotational axis (46) of the at least one caster (32, 34) extends parallel to the first narrow side (18) at a distance from the rotational axis (28).

15. The suitcase as defined in claim 1 wherein the at least one caster (32, 34) of the guide roller (30) has a diameter of about 35 to 70 mm.

16. The suitcase as defined in claim 1 wherein the projection amount of the at least one caster (32, 34) of the guide roller (30) relative to the first vertical narrow side (18) amounts to about 12 to 20 mm.

17. The suitcase as defined in claim 1 wherein the guide roller (30) includes two parallel casters (32, 34) mounted coaxially and defining running planes (36, 38) which extend the same distance from the rotational axis (28) of the guide roller (30).

18. The suitcase as defined in claim 1 wherein the guide roller (30) is mounted in a casing (40) including a connection flange (42) for the main surface (2), the upper side (6) and the first vertical narrow side (18), a recess (44) in which the guide roller (30) is housed, and the guide roller (30) projects beyond the first vertical narrow side (18) by a predetermined amount corresponding substantially to the amount of projection of the casters (16).

19. The suitcase as defined in claim 1 wherein the rotational axis (46) of the casters (32, 34) is spaced a distance from the orthogonally extending rotational axis (28) of the guide roller (30) of about 15 to 25 mm.

20. The suitcase as defined in claim 1 wherein the handle (22) in the upper region of the second vertical narrow side (20) of the case halves (3, 4) is disposed diagonally opposite the first-mentioned casters (16).

* * * * *